US005524929A

United States Patent [19]

Emmel et al.

[11] Patent Number: 5,524,929

[45] Date of Patent: Jun. 11, 1996

[54] BINDING ASSEMBLY

[75] Inventors: John J. Emmel, Blaine; Glen H. Bayer, Jr., Cottage Grove; David C. Windorski, Woodbury; Timothy J. O'Leary, St. Paul, all of Minn.; Mary K. Miller-Bruns, Cedar Park, Tex.

[73] Assignee: Minnesota Mining and Manfacturing Company, St. Paul, Minn.

[21] Appl. No.: 432,824

[22] Filed: May 2, 1995

[51] Int. Cl.[6] ..... B42D 1/00

[52] U.S. Cl. ..... 281/211; 281/23

[58] Field of Search ..... 281/15.1, 21.1, 281/23, 38; 428/40–42

[56] References Cited

U.S. PATENT DOCUMENTS

| | | | |
|---|---|---|---|
| 1,032,166 | 7/1912 | Trussell | 281/23 |
| 1,469,573 | 10/1923 | Aberle . | |
| 1,816,175 | 7/1931 | Buchan | 281/23 |
| 2,061,675 | 11/1936 | Schade | 281/23 |
| 4,715,759 | 12/1987 | Larque | 412/33 |
| 4,770,913 | 9/1988 | Yamamoto | 428/40 |
| 5,013,200 | 5/1991 | Hunden et al. | 281/21.1 |
| 5,050,909 | 9/1991 | Mertens et al. | 283/81 |
| 5,153,041 | 10/1992 | Clements et al. | 428/40 |
| 5,248,164 | 9/1993 | Lepretre | 281/22 |

FOREIGN PATENT DOCUMENTS

| | | | |
|---|---|---|---|
| 0150654B1 | 12/1984 | European Pat. Off. | B42D 1/10 |
| 0266454 | 11/1986 | European Pat. Off. | B42D 1/10 |
| 2409862 | 11/1977 | France | B42D 1/10 |
| 2543066 | 3/1983 | France | B42F 13/00 |
| WO87/02941 | 5/1987 | WIPO | B42F 1/00 |

*Primary Examiner*—Willmon Fridie, Jr.

*Attorney, Agent, or Firm*—Gary L. Griswold; Walter N. Kirn; William L. Huebsch

[57] ABSTRACT

A binding assembly including (1) a plurality of support strips; (2) layers of pressure sensitive adhesive (which could be repositionable, removable or permanent pressure sensitive adhesive) along front surfaces of the support strips; and (3) layers of release material on a rear surfaces of the support strips. The support strips are adhered together to form a support strip stack with inner edges of the support strips in alignment, with the layers of pressure sensitive adhesive on the support strips adhered to the layers of release material on adjacent support strips, and with the front surfaces of the support strips uppermost in the support strip stack. The binding assembly further includes binding means along the inner edges of the support strips that affords separation of the support strips and revolving of the support strips relative to each other around axes generally parallel to their inner edges. Only tension applied through a paper sheet adhered along the full length of the layer of pressure sensitive adhesive on the uppermost one of the support strips adhered in the support strip stack can be used to separate that one support strip from an adjacent support strip adhered to the layer of release material on the front surface of that one support strip and cause revolving of that one support strip away from the support strip from which that one support strip was separated.

20 Claims, 5 Drawing Sheets

BINDING ASSEMBLY

TECHNICAL FIELD

The present invention relates to binding assemblies for use in binding together a plurality of loose sheets by adhering the sheets to layers of pressure sensitive adhesive on parts of assembly.

BACKGROUND ART

The art is replete with binding assemblies for use in binding together a plurality of loose sheets by adhering the sheets to layers of pressure sensitive adhesive on parts of assemblies. European Patent Office Publication No. 0 511 146 A1 and PCT international publication no. WO 87/02941 provide illustrative examples. Heretofore, however, known binding assemblies of this type have included strips of release liner protecting the pressure sensitive adhesive that must be removed before the assembly is used, or the assemblies have had other features that make them less convenient to use than might be desired.

DISCLOSURE OF INVENTION

The present invention provides a binding assembly for use in binding together a plurality of loose sheets by adhering the sheets to layers of pressure sensitive adhesive on parts of assembly, use of which binding assembly does not require removal of strips of release liner, and which is otherwise more easily used to assemble and arrange loose sheets of paper than other known binding assemblies.

The binding assembly according to the present invention generally comprises (1) a plurality of support strips; (2) layers of pressure sensitive adhesive (which could be repositionable, removable or permanent pressure sensitive adhesive) along front surfaces of the support strips; and (3) layers of release material on a rear surfaces of the support strips. The support strips are adhered together to form a support strip stack with inner edges of the support strips in alignment, with the layers of pressure sensitive adhesive on the support strips adhered to the layers of release material on adjacent support strips, and with the front surfaces of the support strips uppermost in the support strip stack. The binding assembly further includes binding means along the inner edges of the support strips that affords separation of the support strips and revolving of the support strips relative to each other around axes generally parallel to their inner edges. The relatively high stiffness of the support strips, the adhesive property of the layer of pressure sensitive adhesive, the level of adhesion between the layers of pressure sensitive adhesive and the layers of release material, and the relatively low resistance to pivotal movement of the support strips relative to each other caused by the binding means being selected so that only tension applied through a paper sheet adhered along the full length of the layer of pressure sensitive adhesive on the uppermost one of the support strips adhered in the support strip stack can be used to separate that one support strip from an adjacent support strip adhered to the layer of release material on the front surface of that one support strip and cause revolving of that one support strip away from the support strip from which that one support strip was separated.

In one embodiment, that binding means along the inner edges of the support strips comprises, for each support strip, an elongate hinge strip that is significantly more flexible around a longitudinal axis than the support strip. The hinge strip has an attachment portion adjacent a first edge adhered along a portion of the support strip adjacent the inner edge of the support strip, an anchor portion adjacent a second opposite edge, and a central hinge portion between the attachment and anchor portions. The major surfaces of the anchor portions are attached together in an anchor stack adapted to have its lowermost surface adhered or otherwise secured to a substrate, and the hinge portions are independently bendable around axes extending longitudinally of the hinge strip to afford revolving of said one support strip away from the support strip from which the one support strip was separated.

In another embodiment, that binding means along the inner edges of the support strips comprises a layer of flexible hot melt adhesive adhered along the inner edges of the support strips; and in yet another embodiment adapted for use in three ring binders that binding means comprises a plurality of aligned through openings in the support strips adapted to be received on and slide along spaced annular rings disposed about a common axis.

The outer edge of each support strip in the support strip stack can project past the outer edge of the next lowermost support strip in the support strip stack by a distance in the range of about 0.008 to 0.063 inch (preferably by about 0.015 inch) which facilitates separating the supports strips from each other. The binding assembly can further include means on the anchor stack adapted to attach the anchor stack to a substrate, which means can be a layer of pressure sensitive adhesive or a hook portion of a hook and loop fastener, or both. Also, the binding assembly can include means on the top of the anchor stack (such as the loop portion of a hook and loop fastener) adapted to have attached thereto the bottom of the anchor stack of another one of the binding assemblies.

The binding assembly can further include an elongate cover strip with a layer of release material on its rear surface, which cover strip is adhered to the top support strip in the stack with their inner edges aligned, and with the layer of pressure sensitive adhesive on the top support strip adhered to the layer of release material on the cover strip, and the binding means can include means along the inner edge of the cover strip for affording separation of the cover strip and revolving of the cover strip relative to the top support strip around axes generally parallel to the inner edges. The significant stiffness of the cover strip, the level of adhesion between the layer of pressure sensitive adhesive on the top support strip stand the layer of release material on the cover strip, and the relatively low resistance to pivotal movement of the cover strip relative to the support strips caused by the binding means are selected so that the cover strip can be easily manually separated from the layer of pressure sensitive adhesive on the top support strip and revolved away from the top support strip by simply engaging the cover strip along one edge.

The length of the cover strip and its width between its inner and outer edges can be essentially the same as the length and width of the support strips, or, alternatively, or can be substantially greater than the length and width of the support strips.

Also, the binding assembly can further include a backing member and the binding means along the inner edges of the support strips can be attached along a front surface of the backing member, and that backing member can be a rear portion of a cover which can also include a front portion attached so that it can be moved relative to the rear portion between open and closed positions.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
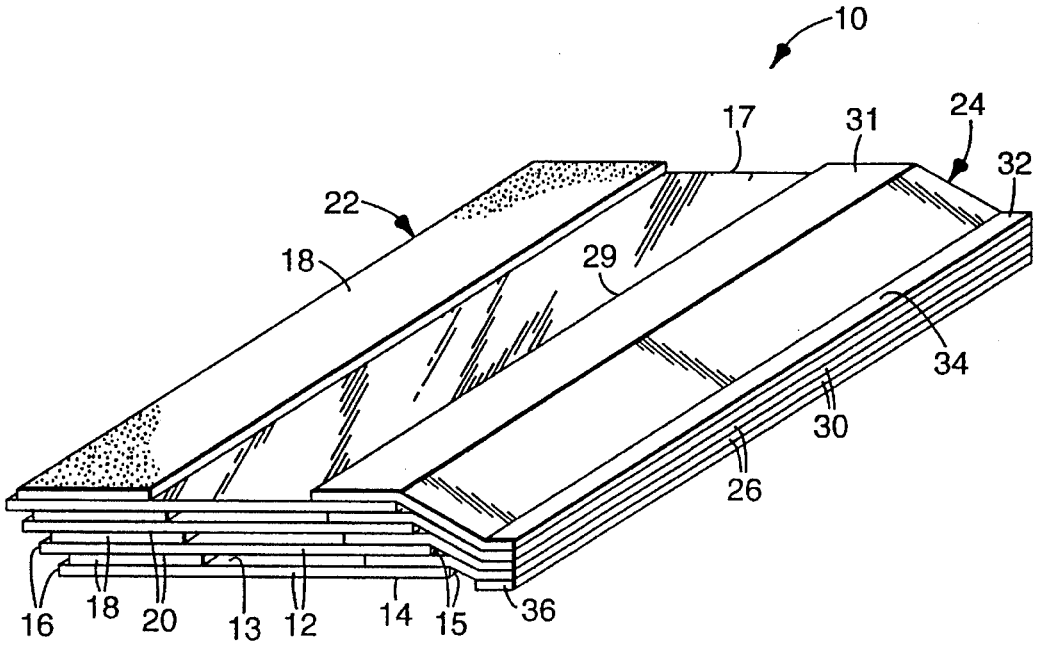
FIG. 1 is a perspective view of a first embodiment of a binding assembly according to the present invention.
Figure 2:
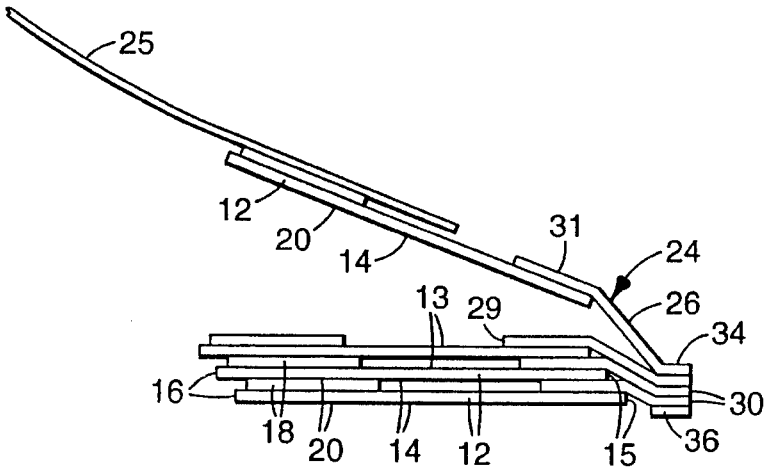
FIG. 2 is an end view of a sheet bound on the binding assembly of FIG. 1 being used to separate a support sheet to which the sheet is releasably adhered from other support sheets in a support sheet stack.

Referring now to FIGS. 1 and 2 of the drawing, there is shown a first embodiment of a binding assembly according to the present invention generally designated by the reference numeral 10, which binding assembly 10 is adapted for binding together a plurality of loose sheets.

Generally the binding assembly 10 comprises a plurality of support strips 12 of a fairly stiff flexible material (e.g., of paper or polymeric material). Each of the support strips 12 has front and rear major surfaces 13 and 14, opposite inner and outer edges 15 and 16, and opposite ends 17. Also each of the support strips 12 has a layer 18 of pressure sensitive adhesive (which could be repositionable, removable or permanent pressure sensitive adhesive depending on the desired application of the binding assembly 10) adhered along its front surface 13, and a layer 20 of release material on its rear surface 14. The support strips 12 are adhered together to form a support strip stack 22 with the inner edges 15 of the support strips 12 in alignment, with the layers 18 of pressure sensitive adhesive on the support strips 12 adhered to the layers 20 of release material on adjacent support strips 12, and with the front surfaces 13 of the support strips 12 uppermost in the support strip stack 22. The binding assembly 10 further includes binding means 24 along the inner edges 15 of the support strips 12 for affording separation of the support strips 12 and revolving of the support strips 12 relative to each other around axes generally parallel to the inner edges 15. The stiffness of the support strips 12 (e.g., a Tabor stiffness value of about 2.638 gram centimeter), the adhesive property of the layer of pressure sensitive adhesive (e.g., a peel value of about 4.6 Newtons/Decimeter), the level of adhesion between the layers 18 of pressure sensitive adhesive and the layers 20 of release material (e.g., a peel value of about 0.57 Newton/Decimeter), and the resistance to pivotal movement of the support strips 12 relative to each other caused by the binding means 24 (e.g., about 0.73 Newton/Decimeter) are selected so that only tension applied through a paper sheet 25 (see FIG. 2) adhered along the full length of the layer 18 of pressure sensitive adhesive on one of the support strips 12 can be used to separate that one support strip 12 from an adjacent support strip 12 adhered to the layer 18 of release material on the rear surface 14 of that one support strip 12 and cause revolving of that one support strip 12 away from the underlying support strip 12 from which that one support strip 12 was separated.

The outer edge 16 of each support strip 12 in the support strip stack 22 projects past the outer edge 16 of the next lowermost support strip 12 in the support strip stack 22 by a distance in the range of about 0.008 to 0.063 inch (e.g., 0.015 inch) which facilitates separating the uppermost support strip 12 from the other supports strips 12 forming the support strip stack 12.

The binding means 24 along the inner edges 15 of the support strips 12 comprises, for each support strip 12, an elongate hinge strip 26 that is significantly more flexible around a longitudinal axis than the support strips 12 (e.g., a Tabor stiffness of about 0.1236 gram centimeter). Each hinge strip 12 has opposite major surfaces, opposite first and second edges 29 and 30, an attachment portion 31 adjacent the first edge 29 adhered along a portion of the support strip 12 adjacent the inner edge 15 of the support strip 12, an anchor portion 32 adjacent the second edge 30, and a central hinge portion between the attachment and anchor portions 31 and 32. The anchor portions 32 are attached or adhered together, major surface to major surface, to form an anchor stack 34, and the hinge portions are independently bendable around axes extending longitudinally of the hinge strip 26 to afford revolving of the one support strip 12 away from the support strip 12 from which that one support strip 12 was separated. The anchor stack 34 is adapted to be secured to a substrate by a layer 36 of a suitable permanent pressure sensitive adhesive along the bottom surface of the lowermost anchor portion in the anchor stack 34.

An example of materials for use in the binding assembly 10 described above (and in those alternate embodiments thereof described below) are as follows. The support strips 12 can be made of polyester in the range of 0.003 to 0.006 inch thick. The pressure sensitive adhesive can be a repositionable acrylate pressure sensitive adhesive such as the isooctylacrylate/octyldecylacrylate/amine bis phenone pressure sensitive adhesive described in European patent application No. 93.901342.1 filed Dec. 18, 1992, the content whereof is incorporated herein by reference. The release material can be a premium silicone release material with a release value of 0.5 to 6 ounces. The material from which the hinge strips are made should be significantly more flexible than the material from which the support strips 12 are made, such as a 0.002 inch thick polyethylene backing material which can be adhered together in the anchor stack 34 and adhered to the support strips 12 by layers of acrylate high tack pressure sensitive adhesive 0.0015 to 0.004 inch thick.

To use the binding assembly 12 to bind several sheets, an edge portion of a first sheet to be bound is adhered along the layer 18 of pressure sensitive adhesive on the uppermost support strip 12 in the support strip stack 22. Tension applied through that first sheet can then be used to peal that uppermost support strip 12 away from the layer 18 of pressure sensitive adhesive on the next lower support strip 12 in the support strip stack 22, as is illustrated in FIG. 2 with the sheet 25, thereby exposing that layer 18 of adhesive so that a second sheet to be bound can be adhered to it. Subsequently tension applied through that second sheet can be used to peal that next lower support strip 12 away from the layer 18 of pressure sensitive adhesive on the yet next lower support strip 12 in the support strip stack 22 thereby exposing that layer 18 of adhesive so that a third sheet can be adhered to it. In this manner, the layers 18 of adhesive on as many of the support strips 12 as needed can be used to bind sheets together. If a user desires to remove or replace an already bound sheet, the user simply peals that sheet from the layer 18 of adhesive and either allows that layer 18 of adhesive to again adhere to the layer 20 of release material on the adjacent support strip 12 or adheres the replacement sheet to it.

Various modifications of the binding assembly 10 according to the present invention are illustrated in FIGS. 3 through 12 in which similar structural elements to those described above with reference to the FIGS. 1 and 2 are identified with similar reference numerals to which has been added one of the suffixes "a" thorough "d".

Figure 3:
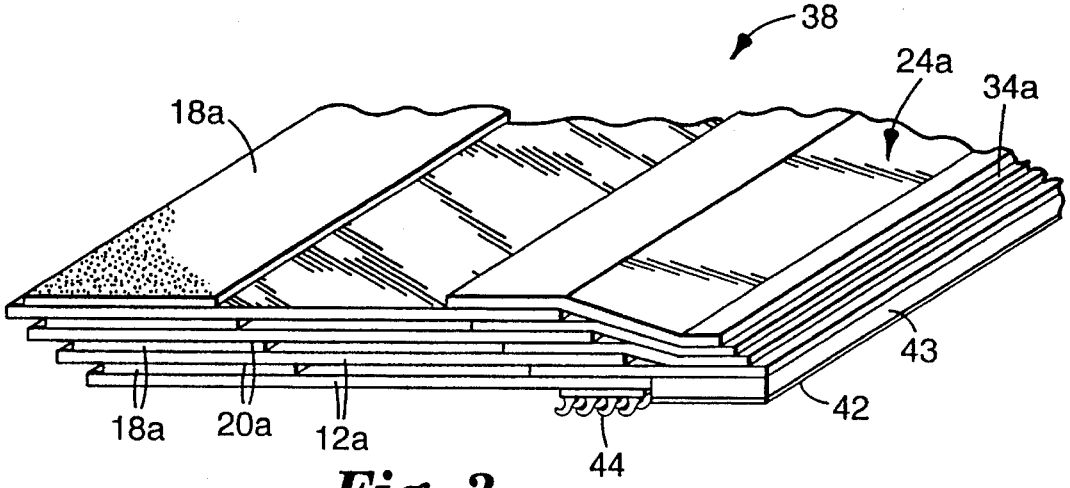
FIG. 3 is a perspective view of a second embodiment of a binding assembly according to the present invention.
Figure 4:
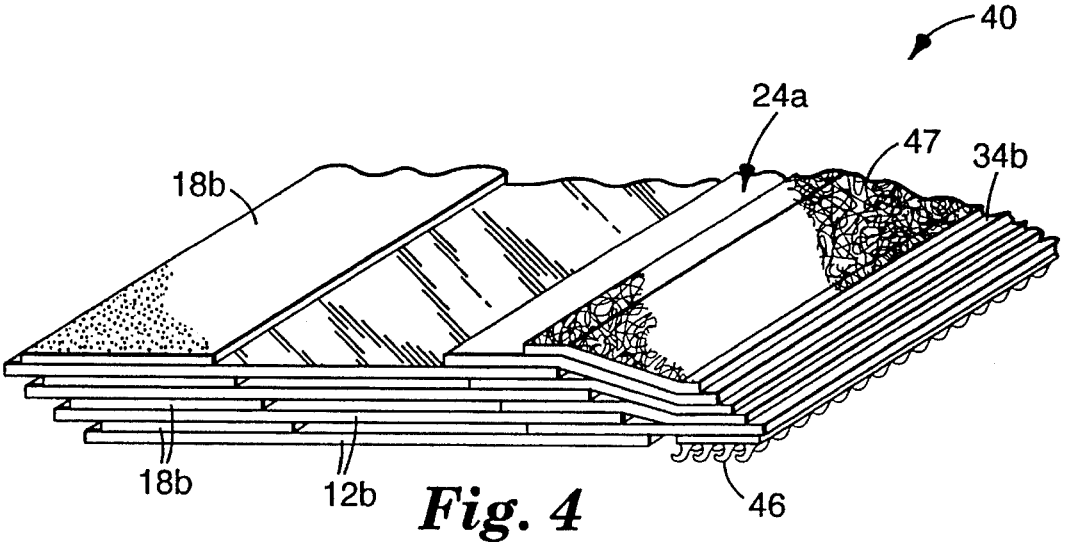
FIG. 4 is a perspective view of a third embodiment of a binding assembly according to the present invention.

FIGS. 3 and 4 illustrate two binding assemblies 38 and 40 that include various means on the anchor stack 34*a* or 34*b* other than the layer 36 of adhesive that are adapted to attach the anchor stack 34*a* and 34*b* to a substrate.

FIG. 3 illustrates the binding assembly 38 in which that means is both a layer 42 of pressure sensitive adhesive along a layer of foam 43, and a hook portion 44 of a hook and loop fastener (e.g., the hook portion described in U.S. Pat. No. 5,116,563, the content whereof is incorporated herein by reference). The use of both the layer 42 of pressure sensitive adhesive and the hook portion 44 affords attaching the binding assembly either to a smooth surface, or to a loop portion of such a fastener, or to various structures with loops along their surfaces such as the walls of certain types of office partitions.

Figure 5:
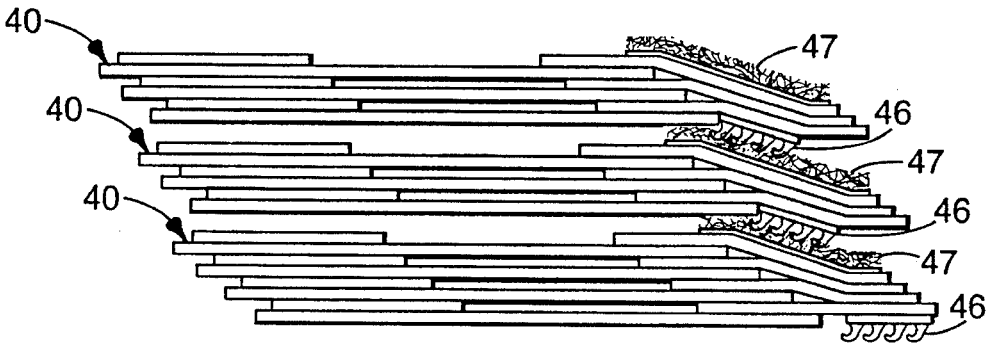
FIG. 5 is an end view of three binding assemblies of the embodiment illustrated in FIG. 4 stacked and attached together.

FIG. 4 illustrates the binding assembly 40 in which that means is a hook portion 46 of a hook and loop fastener and which further includes means on the top surface of its anchor stack 34*b* in the form of a loop portion 47 of a hook and loop fastener (e.g., open woven or nonwoven textile fabric) adapted to have attached thereto the anchor stack 34*b* of another one of the binding assemblies 40. FIG. 5 illustrates binding together three of the binding assemblies 40 which together can bind many more loose sheets than can be bound with only one binding assembly 40. The lowest binding assembly 40 is shown attached to a layer 48 of loop material.

Figure 6:
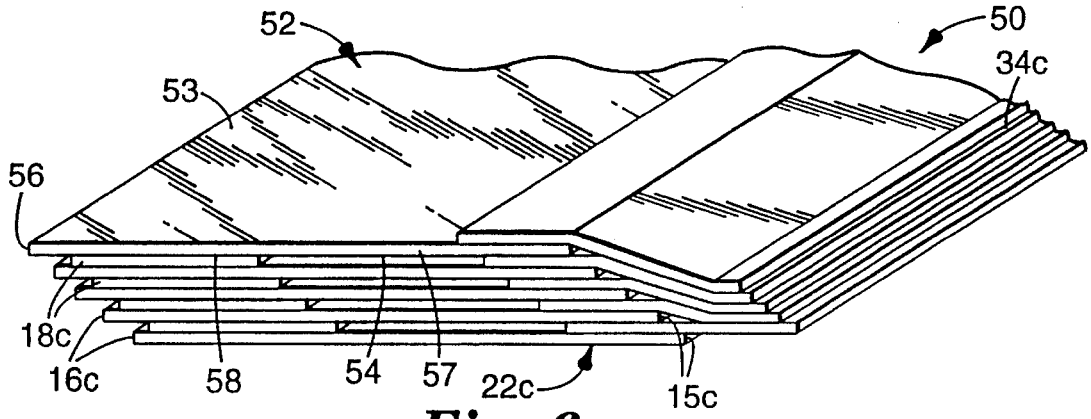
FIG. 6 is a perspective view of a fourth embodiment of a binding assembly according to the present invention.

FIG. 6 illustrates a binding assembly 50 including an elongate cover strip 52 for protecting the layer 18 of adhesive on the uppermost support strip 12*c* before a sheet is attached to it. The cover strip 52 has front and rear major surfaces 53 and 54, opposite inner and outer edges 55 and 56, and opposite ends 57. A layer of release material 58 is adhered on the rear surface 54 of the cover strip 52; and the cover strip 52 is adhered to the top support strip 12*c* in the support stack 22*c* with the inner edge 55 of the cover strip 52 aligned with the inner edges 15*c* of the support strips 12*c*, and with the layer 18*c* of pressure sensitive adhesive on the top support strip 12*c* adhered to the layer of release material 58 on the cover strip 52. The binding means including means along the inner edge 55 of the cover strip 52 for affording separation of the cover strip 52 and revolving of the cover strip 52 relative to the top support strip 12*c* around axes generally parallel to the inner edges 55 and 15*c*; and the stiffness of the cover strip 52, the level of adhesion between the layer 18*c* of pressure sensitive adhesive on the top support strip 12*c* and the layer of release material 58 on the cover strip 52, and the resistance to pivotal movement of the cover strip 52 relative to the support strips 12*c* caused by the binding means are selected so that the cover strip 52 can be easily manually separated from the layer 18*c* of pressure sensitive adhesive on the top support strip 12*c* and revolved away from the top support strip 12*c* by engaging the cover strip 52 along one edge. As illustrated in FIG. 6, the width of the cover strip 52 between its inner and outer edges 55 and 56, and the length of the cover strip 52 between its opposite ends 57 are essentially the same as the widths and lengths of the support strips 12*c*. The materials of the cover strip 52 and in the layer 58 of release material can be the same as the material of the supports strips 12 and in the layer 20 of release material described above. Use of the binding assembly 50 is essentially the same as the use of the binding assembly 10 described above, except that before the first sheet to be bound is adhered along the layer 18*c* of pressure sensitive adhesive on the uppermost support strip 12*c* in the support strip stack 22*c*, the cover strip 52 must be separated from it, which can easily be done by engaging the cover strip 52 along its outer edge 56 and pealing it away.

Figure 7:
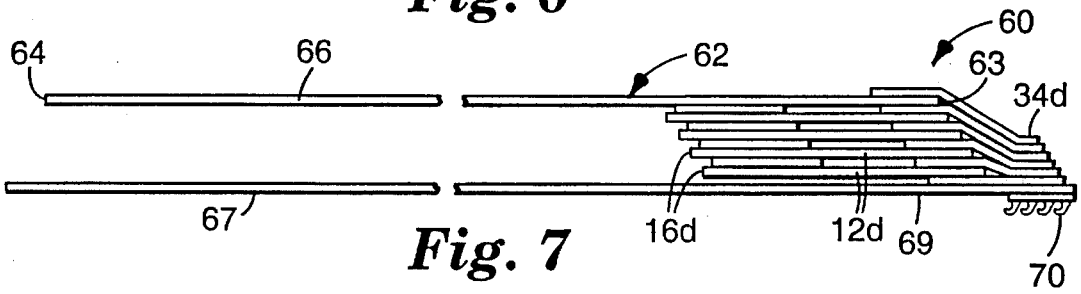
FIG. 7 is a side view of a fifth embodiment of a binding assembly according to the present invention.
Figure 8:
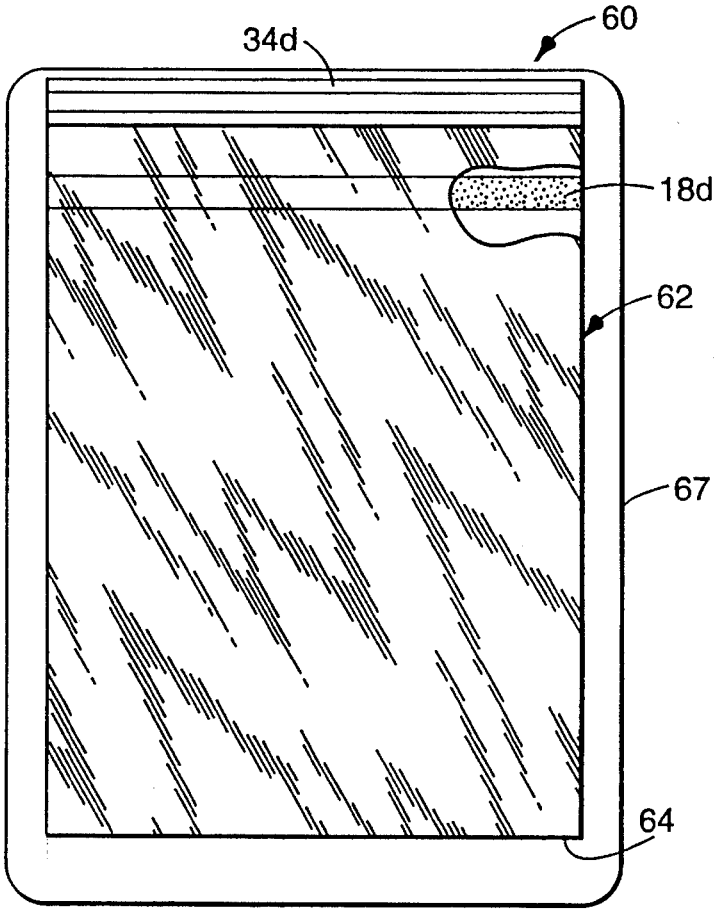
FIG. 8 is a top view of the binding assembly illustrated in FIG. 7.

FIGS. 7 and 8 illustrate a binding assembly 70 having a cover strip 62 in which the width of the cover strip 62 between its inner and outer edges 63 and 64 is substantially greater than the width of the support strips 12*d* between their inner and outer edges 15*d* and 16*d*; and the length of the cover strip 60 between its opposite ends 66 is significantly greater than the lengths of the support strips 12*d* between their ends 17*d* so that the cover strip 62 provides a cover for documents adhered to the binding assembly 60. As is illustrated, the cover strip 62 can be transparent, and the binding assembly 60 can further include a backing member 67 that is slightly larger than the cover strip 62, has a front surface to which the anchor stack 34*d* is attached, and has the hook portion 70 of a hook and loop fastener attached along its rear surface 69 by which the backing member 68 can be releasably attached to loop material. Thus, the binding assembly 60 can be attached by the hook portion 70 to a loop martial such as that on the wall of a cubicle divider.

Figure 9:
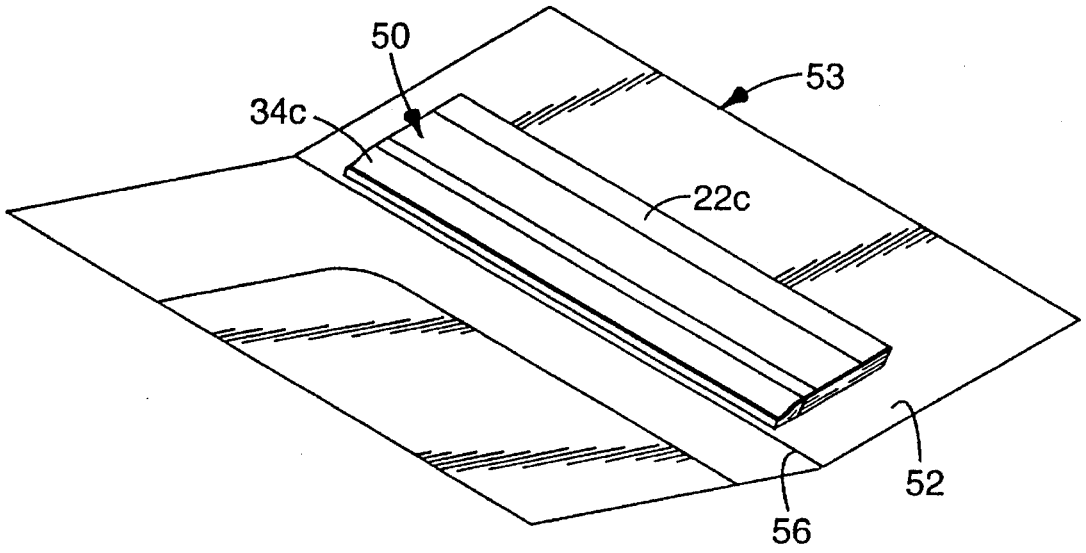
FIG. 9 is a perspective view of the binding assembly of FIG. 6 attached in a first type of folder.

FIG. 9 illustrates the binding assembly 50 of FIG. 6 having its anchor stack 34*c* adhered to a backing member 52, which backing member 52 is a rear portion of a cover or folder 53 including the rear portion 52 and a front portion 54. The front and rear portions 54 and 52 of the folder 53 are joined and folded along adjacent edges 56 to afford movement of the front portion 54 relative to the rear portion 52 from a closed position overlaying the rear portion 52, to an open position spaced from the rear portion 52 as illustrated. The anchor stack 34*c* of the binding assembly 50 extends along the folded edges 56 with the support strip stack 22*c* on the side of the anchor stack 34*c* opposite the folded edges 56. The folder 53 is of the type commonly used to carry travel documents particularly including airline tickets, and may be made of any suitable paper or polymeric material (e.g., 0.010 inch thick polyethylene terephthalate). The binding assembly 50 is particularly useful in such a folder 53 as it affords binding together various types an sizes of documents accumulated while traveling, such as ticket stubs, and various receipts for parking, taxis, hotels and the like.

Figure 10:
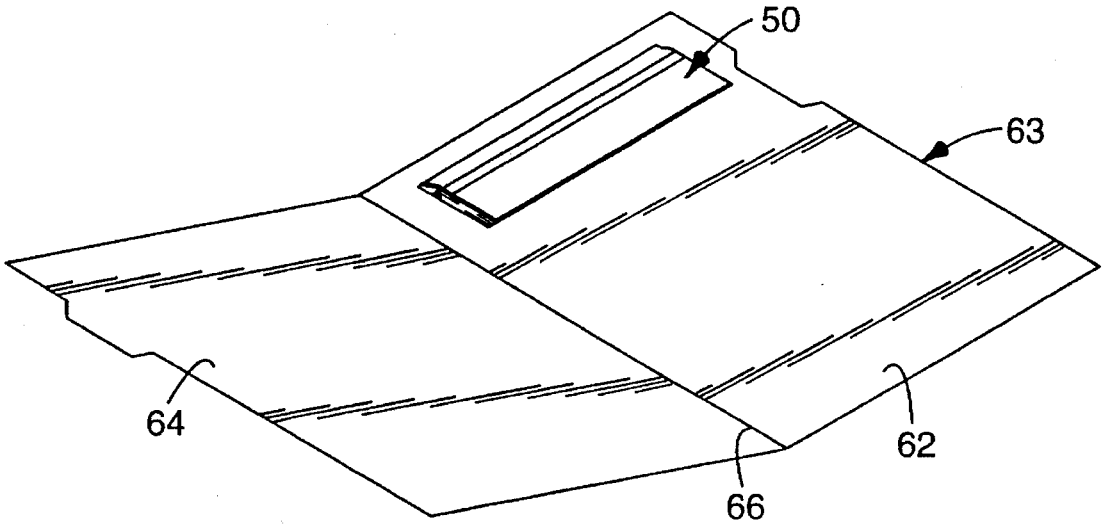
FIG. 10 is a perspective view of the binding assembly of FIG. 6 attached in a second type of folder.

FIG. 10 illustrates the binding assembly 50 of FIG. 6 having its anchor stack 34*c* adhered to a backing member 62 which is a rear portion of a cover or folder 63 including the rear portion 62 and a front portion 64. The front and rear portions 64 and 62 are joined and folded along a common aligned edge or fold 66 to afford movement of the cover portion 64 relative to the rear portion 62 from a closed position overlaying the rear portion 62, to an open position spaced from the rear portion 62 as illustrated. The binding assembly 50 extends at a right angle to the fold 66 along one end of the rear portion 62 of the folder 63. The folder 63 is of the type commonly used to collect larger documents (e.g., typically 8 and one half by 11 inches in size) relating to a single subject, and may be made of any suitable paper or polymeric material.

Figure 11:
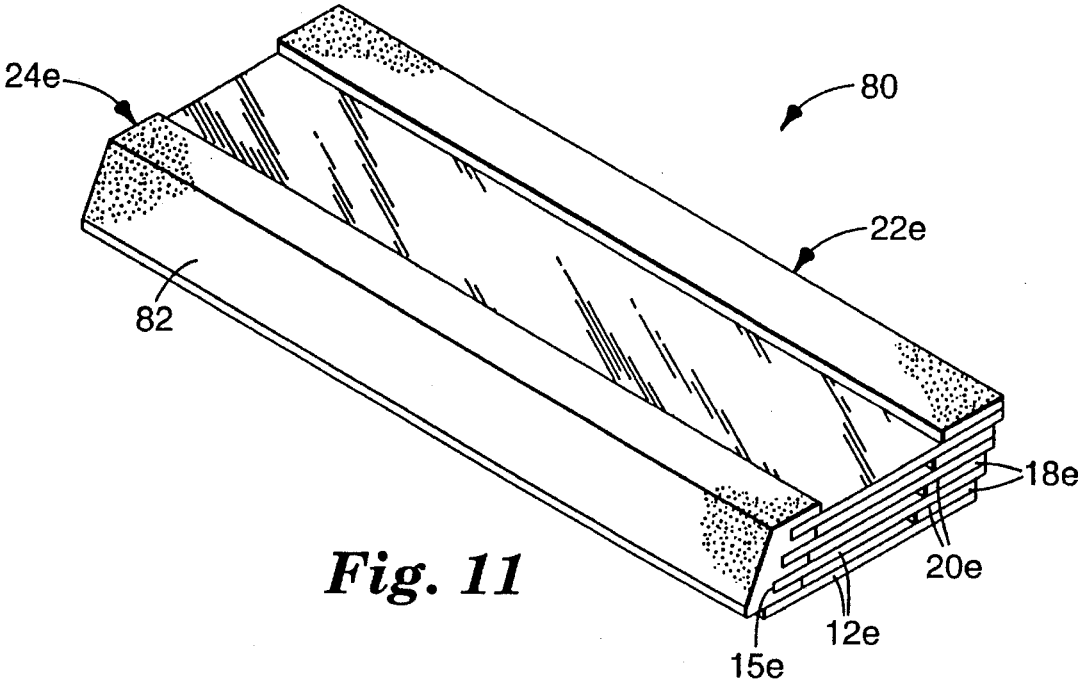
FIG. 11 is a perspective view of a sixth embodiment of a binding assembly according to the present invention.

FIG. 11 illustrates a binding assembly 80 according to the present invention which, like the binding assembly 10, includes a plurality of support strips 12*e*, each of which has as a layer 18*e* of pressure sensitive adhesive (which could be repositionable, removable or permanent pressure sensitive adhesive) adhered along its front surface, and a layer 20*e* of release material on its rear surface, which support strips 12*e* are adhered together to form a support strip stack 22*e* with the inner edges of the support strips 12*e* generally in alignment, with the layers 18*e* of pressure sensitive adhesive on the support strips 12*e* adhered to the layers 20*e* of release material on adjacent support strips 12*e*, and with the front surfaces of the support strips 12*e* uppermost in the support strip stack 22. Also, the binding assembly 80 further includes binding means 24*e* along the inner edges of the support strips 12*e* for affording separation of the support strips 12*e* and revolving of the support strips 12*e* relative to each other around axes generally parallel to the inner edges. Unlike the binding assembly 10, however, in the binding assembly 80 that binding means 24*e* comprises a layer 82 of flexible hot melt adhesive adhered along the inner edges 15*e* and an adjacent portion of the front surface of the support strips 12, which layer 82 of hot melt adhesive will not adhere to the layers 20*e* of release material on the support strips 12*e*. A suitable hot melt adhesive for forming that layer 82 is ethylene vinyl acetate such as that sold under the trade designation "Elvax" (R.T.M.) by DuPont Chemical Company, Wilmington, Delaware, or that sold under the trade designation "Ultrathene" (R.T.M.) by Quantum Chemical Corp., USI Division, Cincinnati, Ohio.

Figure 12:
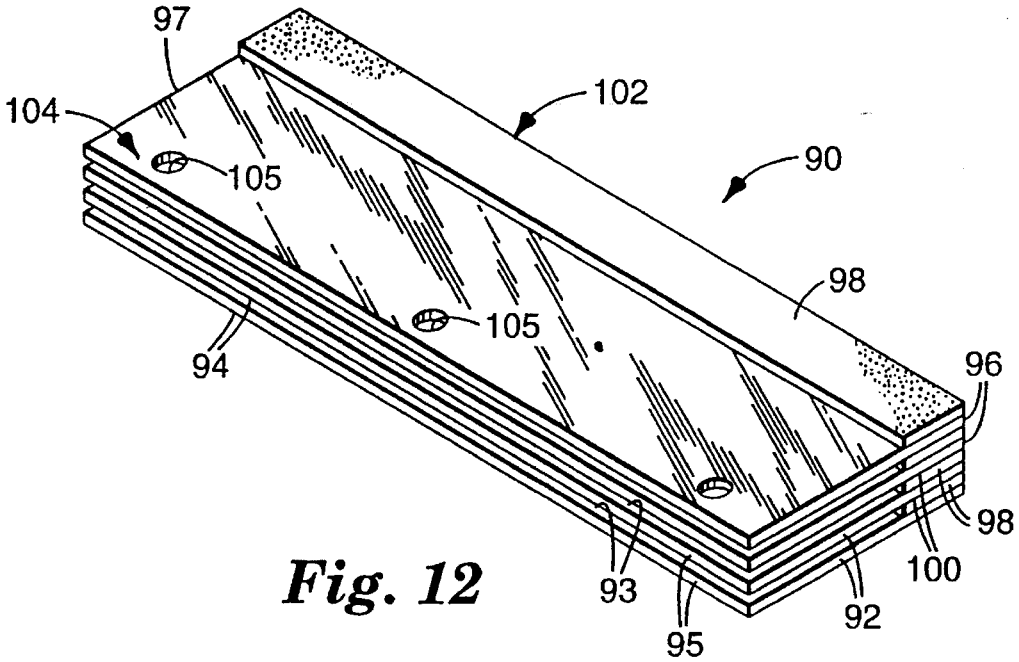
FIG. 12 is a perspective view of a seventh embodiment of a binding assembly according to the present invention.

FIG. 12 illustrates a binding assembly 90 according to the present invention which generally comprises a plurality of support strips 92 of a fairly stiff flexible material (e.g., of the same material as the support strips 12). Each of the support strips 92 has front and rear major surfaces 93 and 94, opposite inner and outer edges 95 and 96, and opposite ends 97. Also each of the support strips 92 has a layer 98 of pressure sensitive adhesive adhered along its front surface 93, and a layer 100 of release material on its rear surface 94. The support strips 92 are adhered together to form a support strip stack 102 with the inner edges 95 of the support strips 92 in alignment, with the layers 98 of pressure sensitive adhesive on the support strips 92 adhered to the layers 100 of release material on adjacent support strips 92, and with the front surfaces 93 of the support strips 92 uppermost in the support strip stack 102. The binding assembly 90 further includes binding means 104 along the inner edges 95 of the support strips 92 for affording separation of the support strips 92 and revolving of the support strips 92 relative to each other around axes generally parallel to the inner edges 95. The stiffness of the support strips 92, the adhesive property of the layer 98 of pressure sensitive adhesive, the level of adhesion between the layers 88 of pressure sensitive adhesive and the layers 100 of release material, and the resistance to pivotal movement of the support strips 92 relative to each other caused by the binding means 104 are selected so that only tension applied through a paper sheet (not shown) adhered along the full length of the layer 98 of pressure sensitive adhesive on one of the support strips 92 can be used to separate that one support strip 92 from an adjacent support strip 92 adhered to the layer 98 of release material on the rear surface 94 of that one support strip 92 and cause revolving of that one support strip 92 away from the underlying support strip 92 from which that one support strip 92 was separated.

In the binding assembly 90, the binding means 104 along the inner edges 95 of the support strips 92 for affording separation of the support strips 92 and revolving of the support strips 92 relative to each other around axes generally parallel to the inner edges 95 comprises a plurality of aligned through openings 105 in the support strips 12 adapted to be received on and slide along spaced annular rings (not illustrated) disposed about a common axis, and the openings 105 are spaced so that the binding assembly 90 is adapted for use on the rings of a three ring binder. If desired, a cover strip (not illustrated) could also be provided on the binding assembly 90. Use of the binding assembly 90 without or with the cover strip would be essentially the same as the use of the binding assemblies 10 and 50 described above.

The present invention has now been described with reference to numerous embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

We claim:

1. A binding assembly for binding a plurality of loose sheets together, said binding assembly comprising;

a plurality of support strips, each of which support strips has front and rear major surfaces, opposite inner and outer edges, and opposite ends;

a layer of pressure sensitive adhesive along said front surface of said support strip;

a layer of release material on the rear surface of said support strip;

said support strips being adhered together to form a support strip stack with said inner edges of said support strips in alignment, with the layers of pressure sensitive adhesive on the support strips adhered to the layers of release material on adjacent support strips, and with the front surfaces of the support strips uppermost in the stack;

said binding assembly further including binding means along said inner edges of said support strips for affording separation of said support strips and revolving of said support strips relative to each other around axes generally parallel to said inner edges;

the stiffness of said support strips, the adhesive property of the layer of pressure sensitive adhesive, the level of adhesion between said layers of pressure sensitive adhesive and said layers of release material, and the resistance to pivotal movement of said support strips relative to each other caused by said binding means being selected so that only tension applied through a paper sheet adhered along the full length of the layer of pressure sensitive adhesive on one of the support strips can be used to separate that one support strip from an adjacent support strip adhered to the layer of release material on the surface of that one support strip and cause revolving of that one support strip away from the support strip from which said one support strip was separated.

2. A binding assembly according to claim 1 wherein the outer edge of each support strip in the support strip stack projects past the outer edge of the next lowermost support strip in the support strip stack by a distance in the range of about 0.008 to 0.063 inch.

3. A binding assembly according to claim 1 wherein said binding means along said inner edges of said support strips for affording separation of said support strips and revolving of said support strips relative to each other around axes generally parallel to said inner edges comprises, for each support strip, an elongate hinge strip that is significantly more flexible around a longitudinal axis than said support strip, said hinge strip having opposite major surfaces, opposite first and second edges, an attachment portion adjacent said first edge adhered along a portion of said support strip adjacent the inner edge of said support strip, an anchor portion adjacent said second edge, and a central hinge portion between said attachment and anchor portions, said anchor portions being attached together in an anchor stack adapted to be secured to a substrate and said hinge portions being independently bendable around axes extending longitudinally of said hinge strip to afford revolving of said one support strip away from the support strip from which said one support strip was separated.

4. A binding assembly according to claim 1 wherein said binding means along said inner edges of said support strips for affording separation of said support strips and revolving of said support strips relative to each other around axes generally parallel to said inner edges comprises a layer of flexible hot melt adhesive adhered along the inner edges of said support strips.

5. A binding assembly according to claim 1 wherein said binding means along said inner edges of said support strips for affording separation of said support strips and revolving of said support strips relative to each other around axes generally parallel to said inner edges comprises a plurality of aligned through openings in said support strips adapted to be received on and slide along spaced annular rings disposed about a common axis.

6. A binding assembly according to claim 3 further including means on said anchor stack adapted to attach said anchor stack to a substrate.

7. A binding assembly according to claim 6 wherein said means on said anchor stack adapted to attach said anchor stack to a substrate comprises a layer of pressure sensitive adhesive.

8. A binding assembly according to claim 6 wherein said means on said anchor stack adapted to attach said anchor stack to a substrate comprises a hook portion of a hook and loop fastener.

9. A binding assembly according to claim 6 wherein said means on said anchor stack adapted to attach said anchor stack to a substrate comprises a layer of pressure sensitive adhesive.

10. A binding assembly according to claim 1 further including means on said anchor stack adapted to attach said anchor stack to a substrate and means on said substrate adapted to have attached thereto the anchor stack of another one of said binding assemblies.

11. A binding assembly according to claim 10 wherein said means on said anchor stack adapted to attach said anchor stack to a substrate comprises a hook portion of a hook and loop fastener, and said means on said substrate adapted to have attached thereto the anchor stack of another one of said binding assemblies comprises the loop portion of a hook and loop fastener.

12. A binding assembly according to claim 1 further including an elongate cover strip having front and rear major surfaces, opposite inner and outer edges, and opposite ends; a layer of release material on the rear surface of said cover strip; said cover strip being adhered to the top support strip in said stack with the inner edge of said cover strip aligned with the inner edges of said support strips, and with the layer of pressure sensitive adhesive on said top support strip adhered to the layer of release material on the cover strip; said binding means including means along said inner edge of said cover strip for affording separation of said cover strip and revolving of said cover strip relative to said top support strip around axes generally parallel to said inner edges; the stiffness of said cover strip, the level of adhesion between the layer of pressure sensitive adhesive on said top support strip stand said layer of release material on said cover strip, and the resistance to pivotal movement of said cover strip relative to said support strips caused by said binding means being selected so that said cover strip can be easily manually separated from the layer of pressure sensitive adhesive on said top support strip and revolved away from the top support strip by engaging the cover strip along one edge.

13. A binding assembly according to claim 12 wherein the width of said cover strip between said inner and outer edges of said cover strip, and the length of said cover strip between said opposite ends of said cover strip is essentially the same as the width of said support strips between said inner and outer edges of said support strips and the lengths of said support strips between said ends of said support strips.

14. A binding assembly according to claim 12 wherein the width of said cover strip between said inner and outer edges of said cover strip is substantially greater than the width of said support strips between said inner and outer edges of said support strips, and the length of said cover strip between said opposite ends of said cover strip is greater than the lengths of said support strips between said ends of said support strips.

15. A binding assembly according to claim 1 further including a backing member having front and rear surfaces with said binding means along said inner edges of said support strips being attached along the front surface of said backing member.

16. A binding assembly according to claim 14 wherein said backing member is a rear portion of a cover including said rear portion and a front portion, said front and rear portions having aligned edges and means along said edges attaching said front and rear portions together and affording movement of said cover portion relative to said rear portion from a closed position overlaying said rear portion, to an open position spaced from said rear portion.

17. A binding assembly according to claim 1 further including as backing member having front and rear surfaces with said binding means along said inner edges of said support strips being attached along the front surface of said backing member.

18. A binding assembly according to claim 1 wherein said layers of pressure sensitive adhesive along said front surfaces of said support strips are of repositionable pressure sensitive adhesive.

19. A binding assembly according to claim 1 wherein said layers of pressure sensitive adhesive along said front surfaces of said support strips are of removable pressure sensitive adhesive.

20. A binding assembly according to claim 1 wherein said layers of pressure sensitive adhesive along said front surfaces of said support strips are of permanent pressure sensitive adhesive.

* * * * *